US011400479B1

(12) United States Patent
Ellis

(10) Patent No.: US 11,400,479 B1
(45) Date of Patent: Aug. 2, 2022

(54) ADHESIVE APPLICATOR CONTROL SYSTEM

(71) Applicant: Michael A. Ellis, Chickamauga, GA (US)

(72) Inventor: Michael A. Ellis, Chickamauga, GA (US)

( * ) Notice: Subject to any disclaimer, the term of this patent is extended or adjusted under 35 U.S.C. 154(b) by 286 days.

(21) Appl. No.: 16/840,222

(22) Filed: Apr. 3, 2020

(51) Int. Cl.

| | |
|---|---|
| ***B05C 1/08*** | (2006.01) |
| ***B05C 1/16*** | (2006.01) |
| ***B05C 11/10*** | (2006.01) |
| ***D06N 7/00*** | (2006.01) |

(52) U.S. Cl.
CPC ..... *B05C 1/0895* (2013.01); *B05C 1/083* (2013.01); *B05C 1/16* (2013.01); *B05C 11/1005* (2013.01); *B05C 11/1018* (2013.01); *B05C 11/1023* (2013.01); *B05C 11/1026* (2013.01); *B05C 11/1039* (2013.01); *D06N 7/0073* (2013.01)

(58) Field of Classification Search
None
See application file for complete search history.

(56) References Cited

U.S. PATENT DOCUMENTS 2,618,575 A * 11/1952 Oswin ..... C08J 7/0427 118/415
3,542,613 A * 11/1970 Roy ..... D06N 7/0073 156/499
3,627,557 A * 12/1971 Masamichi et al. ... G03G 15/10 430/118.2
3,638,607 A * 2/1972 Jaffke ..... B05C 1/083 118/261
3,647,525 A * 3/1972 Dahlgren ..... B05C 1/0821 427/428.15
3,788,271 A * 1/1974 Carpenter ..... B05C 1/003 118/235
3,889,634 A * 6/1975 Gailey ..... D06B 15/085 118/325
4,426,412 A * 1/1984 Gebert ..... D21H 23/36 118/410
4,480,582 A * 11/1984 Schaefer ..... B05C 1/12 118/104
4,738,879 A * 4/1988 Williams ..... B05C 1/0826 118/259
4,793,892 A * 12/1988 Miller ..... B28B 19/0092 156/324
4,882,005 A * 11/1989 Thompson ..... B32B 3/28 118/259

(Continued)

*Primary Examiner* — Jethro M. Pence
(74) *Attorney, Agent, or Firm* — Quickpatents, LLC; Kevin Prince

(57) ABSTRACT

An apparatus for coating carpet webs in a coating apparatus with varying adhesives includes a controller, one or more sensors for detecting a volume of a puddle of the adhesive pooled in front of an application roller, and an electronic valve in fluid communication with each of a plurality of mixers. The electronic valve directs flow of the adhesive from any of the mixers to the coating apparatus. To switch from one of the adhesives to new adhesive as a next carpet web passes through the coating apparatus, the controller calculates a remaining length of the carpet web that can be coated with the adhesive in the puddle of adhesive based on the volume of the puddle, so that the puddle of the adhesive coats the carpet web, and then proximate a seam to the next carpet web, the new adhesive begins to coat the next carpet web.

5 Claims, 4 Drawing Sheets

(56) References Cited

U.S. PATENT DOCUMENTS 5,149,372 A * 9/1992 Ives ..... B05C 3/18 118/414
5,533,045 A * 7/1996 Hasegawa ..... H04B 1/707 375/141
6,264,775 B1 * 7/2001 Holeschovsky ..... D06N 7/0086 156/331.7
6,620,240 B2 * 9/2003 Choi ..... B05C 9/04 118/259
6,866,715 B1 * 3/2005 Ruschak ..... B05C 1/0813 101/169
7,018,492 B1 * 3/2006 Mumm ..... D06N 7/0073 428/95
8,821,148 B2 * 9/2014 Koizumi ..... B05C 5/027 425/197
8,839,737 B2 * 9/2014 Weber ..... B41F 19/001 118/223
8,857,370 B2 * 10/2014 Kida ..... D21H 25/005 118/712
9,475,081 B1 * 10/2016 Ellis ..... B05C 9/04
9,604,439 B1 * 3/2017 Ellis ..... D06N 7/0071
9,636,700 B2 * 5/2017 Nitschke ..... B05C 11/00
9,731,316 B2 * 8/2017 Ukegawa ..... A61F 13/15593
10,246,286 B2 * 4/2019 Erkelenz ..... B65H 20/16
10,738,401 B2 * 8/2020 Sick ..... D02J 1/22
2002/0134486 A1 * 9/2002 Brumbelow ..... D06N 7/0068 156/72
2004/0198120 A1 * 10/2004 Scott ..... B32B 11/10 442/268
2007/0212513 A1 * 9/2007 Rokkjaer ..... D06N 7/0073 428/95
2009/0246396 A1 * 10/2009 Nakazawa ..... B05C 1/0813 427/428.18
2010/0272946 A1 * 10/2010 Pepper ..... D06N 7/0073 156/72
2014/0287184 A1 * 9/2014 Mastrangelo ..... D06N 7/0073 423/430

* cited by examiner

ADHESIVE APPLICATOR CONTROL SYSTEM

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to carpet manufacturing, and more particularly to precision adhesive application to a carpet web.

BACKGROUND

One of the steps of manufacturing carpet is to coat a bottom side of the carpet tufts with an adhesive layer to bind the carpet tufts together. Different types of carpet, and different carpet applications, often require different types of adhesives. A carpet manufacturing line a coating applicator machine, such as disclosed in my previous U.S. Pat. No. 9,475,081 on Oct. 25, 2016, is used to apply an adhesive to a carpet web. Once a first type of carpet web is coated, typically the next type of carpet web is sewn to the first carpet web to simply feeding of the new carpet web through the coating applicator machine and other manufacturing machines on the line.

If a new carpet web is introduced typically the adhesive in such a coating applicator must be changed as well, resulting in significant down time, loss of efficiency, and/or over/under application weight of latex adhesive for the carpet manufacturing line. It is possible to feed such a coating applicator machine with two or more different adhesive mixers, but heretofore it has been difficult to accurately detect when to swap-out an old u adhesive from a first adhesive mixer with a new adhesive from a second adhesive mixer in a way where the transition of the old adhesive to the new adhesive occurs proximate a seam between the first carpet web and the second carpet web. The result is either a relatively large section of the first carpet web with the new adhesive, or a relatively large section of the second carpet web with the old adhesive, or an inappropriate volume of latex adhesive applied, and such mismatches must typically be scraped as waste.

Therefore, there is a need for a device that can automatically control the exchanging of a first adhesive with a second adhesive in a coating apparatus in such a manner that the scrap is minimized. Such a needed invention would allow for the recovery of unused adhesive, and would be relatively simple to operate. The present invention accomplishes these objectives.

SUMMARY OF THE INVENTION

The present device is an apparatus for coating a first carpet web fixed at a carpet seam with a second carpet web, with two or more adhesives. The adhesives are generated by two or more adhesive mixers and conveyed to a coating apparatus of the type having at least a support bed and either a motorized applicator roller or a blade-type gate.

A controller of the apparatus has at least a processor, a non-volatile memory, a power source, a sensor interface, and a control interface. The apparatus includes one or more sensors for detecting a height and a length of a puddle of one of the adhesives that pools in front of the application roller or the blade-type gate. The sensors are connected with the sensor interface of the controller through a first sensor line.

An electronic valve is in fluid communication with each of the mixers and with the coating apparatus. The electronic valve is adapted to direct flow of the adhesive from any of the mixers to the coating apparatus. Typically the electronic valve is a 3-way or 4-way valve that connects one, two mixers or more to the coating apparatus.

A plurality of control lines each electrically connect the control interface of the controller to each of the adhesive mixers and the electronic valve. The controller is adapted to regulate the speed of delivery of the adhesive from each of the mixers and to direct the flow of the adhesive from any of the mixers to the coating apparatus through actuation of the electronic valve.

Preferably the apparatus further includes a seam detection sensor fixed above the carpet webs and adapted for detecting the carpet seam to alert the controller of the seam approaching the coating apparatus via a second sensor line that is electronically fixed between the seam detection sensor and the controller.

As such, when switching from one of the adhesives to another of the adhesives as the carpet seam of the carpet webs pass through the coating apparatus, the controller calculates a volume of the puddle of adhesive being applied to the carpet web and a remaining length of the carpet web that can be coated with the adhesive in the puddle of adhesive, based on a height, length, and speed of the carpet web passing through the coating apparatus. When the remaining length corresponds with a remaining length of the carpet web to the carpet seam, the controller actuates the electronic valve to switch to another of the adhesives, so that the puddle of the adhesive coats the carpet web, and then proximate the seam, the new adhesive begins to coat the second carpet web.

The controller calculates a volume of the puddle by multiplying the width of the carpet webs by an estimate of the cross-sectional area of the puddle. By shutting off the mixer that is supplying the adhesive to the coating apparatus and detecting how quickly the volume drops as the adhesive is applied to the carpet web, for example, the remaining length of the carpet web that can be coated with the adhesive in the puddle can be calculated. The radius of the applicator roller is a parameter that is stored in the non-volatile memory of the controller, as is the width of the carpet web. As such, the sensors simply have to determine the height and the length of the puddle to allow the controller to determine the remaining length of the carpet web that can be coated with the adhesive in the puddle of adhesive.

In some embodiments the apparatus further includes one or two recovery containers that are each fed by a recovery line that is fluidly connected to the electronic valve, such that adhesive from the mixers that is not being delivered to the coating apparatus through the electronic valve is recovered through the recovery line and saved within the recovery container. In some embodiments additional valves are connected with the controller such that adhesive being mixed by a mixer that is not being used is returned to either the recovery container or the adhesive source container, as appropriate for recovery or reuse.

In some embodiments, the apparatus further includes a coating apparatus control line that is electrically connected between the coating apparatus and the controller. The controller in such an embodiment is adapted to switch on or off the coating apparatus, and to adjust the speed of the carpet webs traveling through the coating apparatus, such that if the puddle of adhesive drops below a predetermined volume, the coating apparatus may be lowed or shut down by the controller. This is done for efficiency so that operators may correct any adhesive supply issues, and also for safety.

The present invention is a device that automatically controls the exchanging of a first adhesive with a second adhesive in a coating apparatus in such a manner that the transition from a first carpet web to a second carpet web is closely correlated to the transition from the first adhesive to the second adhesive, thereby minimizing carpet that must be scrapped. The present apparatus allows for the recovery of unused adhesives, and is relatively simple to operate. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
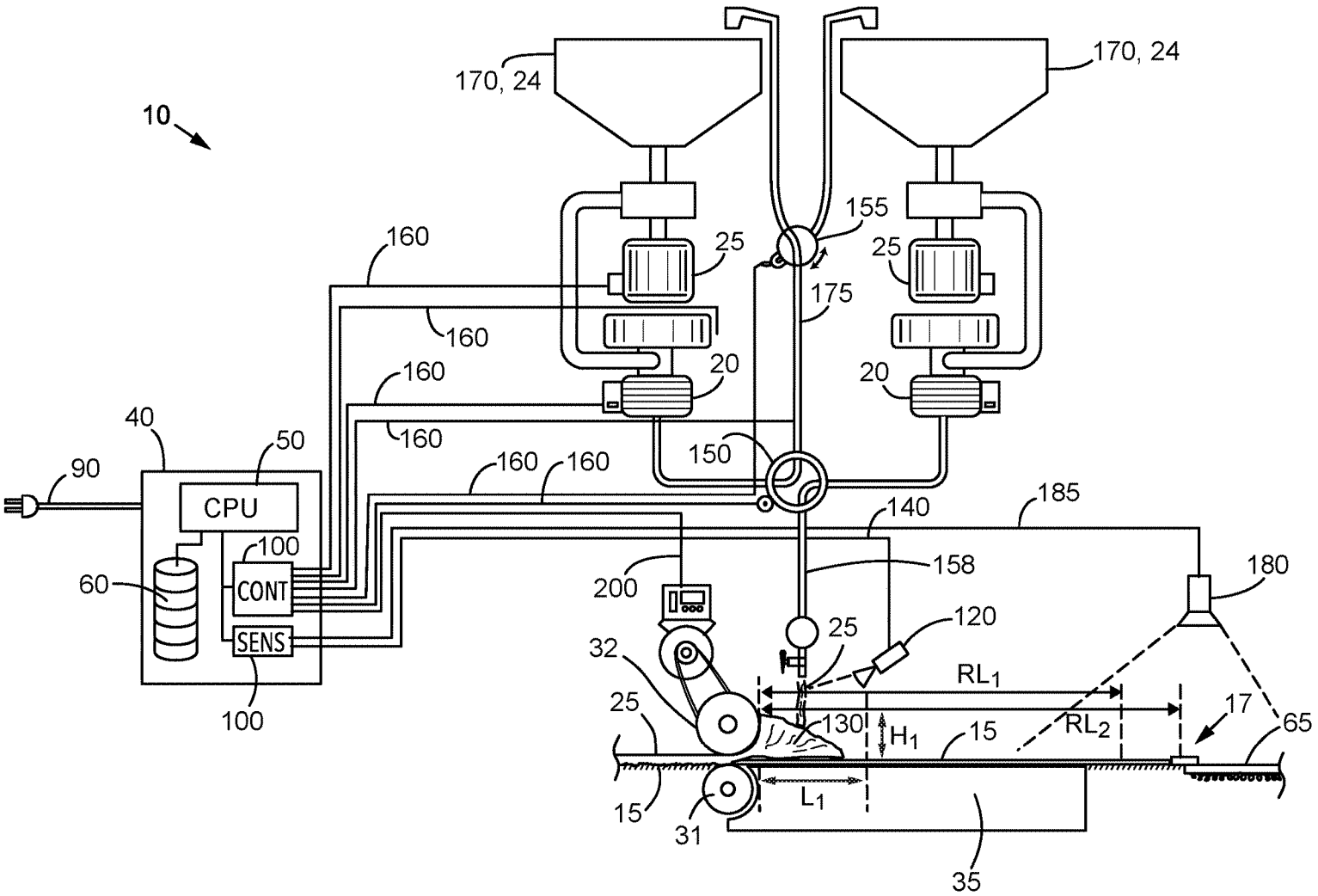
FIG. 1 is a diagram of the invention.
Figure 2:
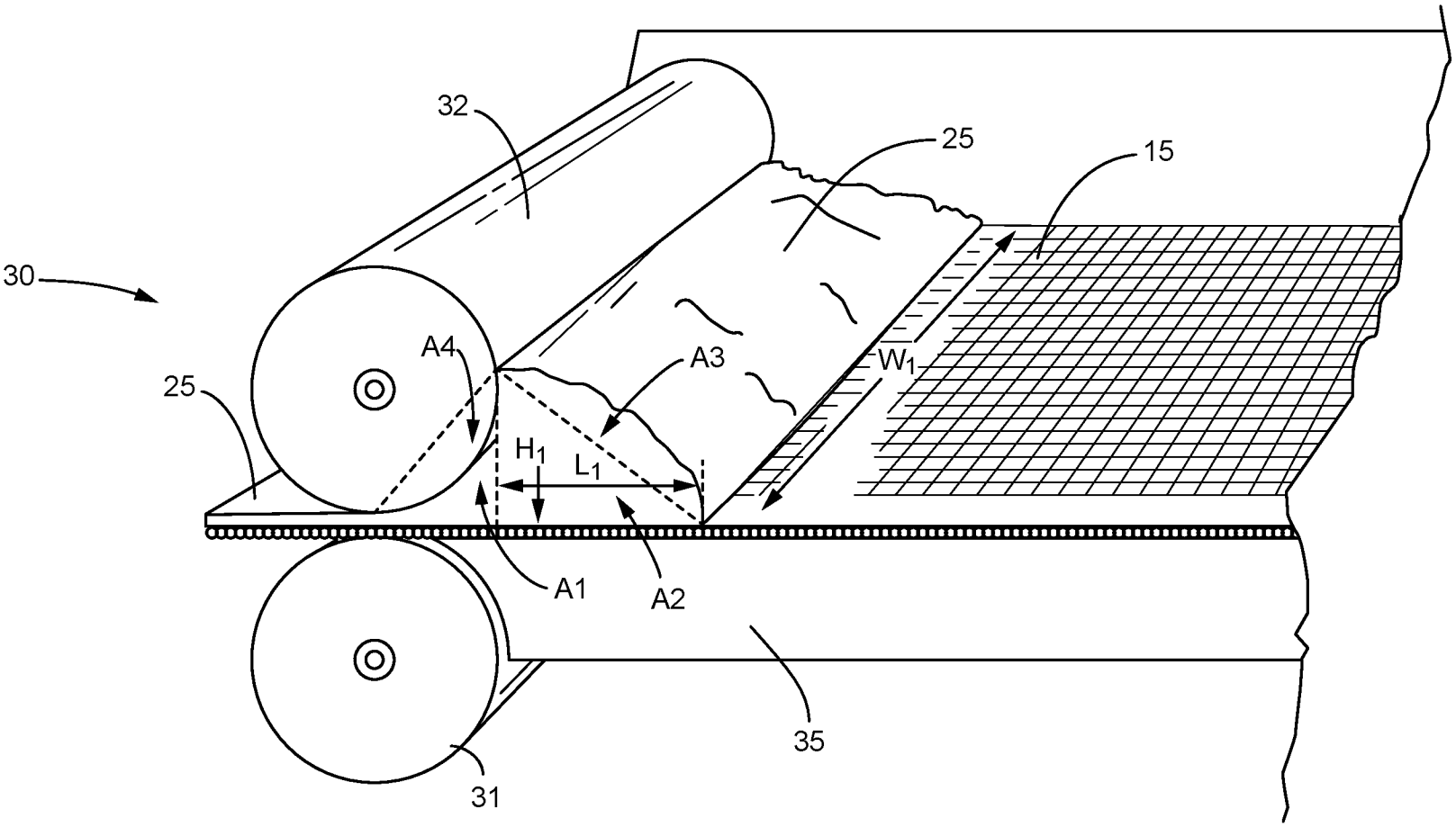
FIG. 2 is partial, enlarged perspective view of a coating apparatus, illustrating an adhesive as being applied to a carpet web.
Figure 3:
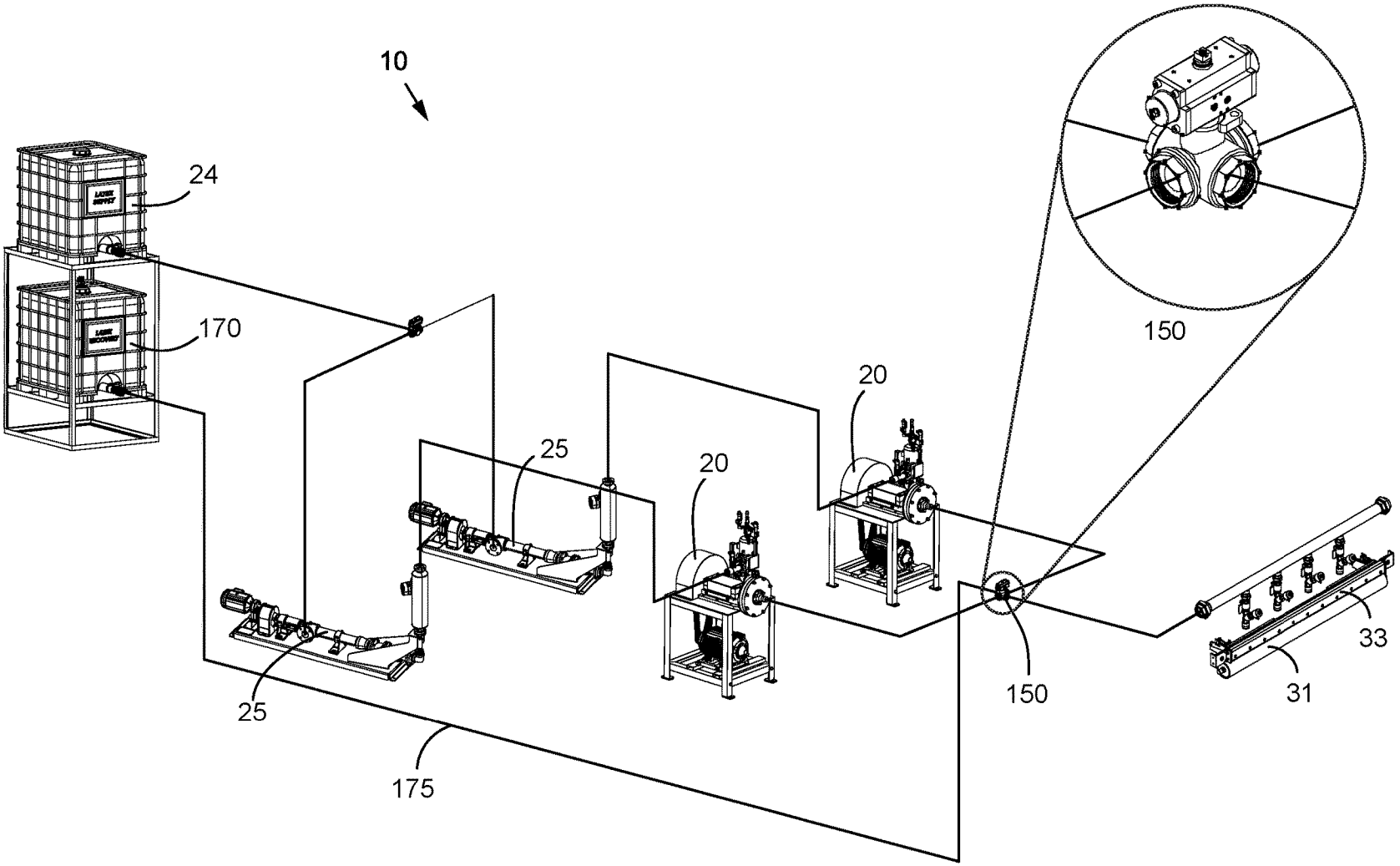
FIG. 3 is a diagram of an alternate embodiment of the invention.
Figure 4:
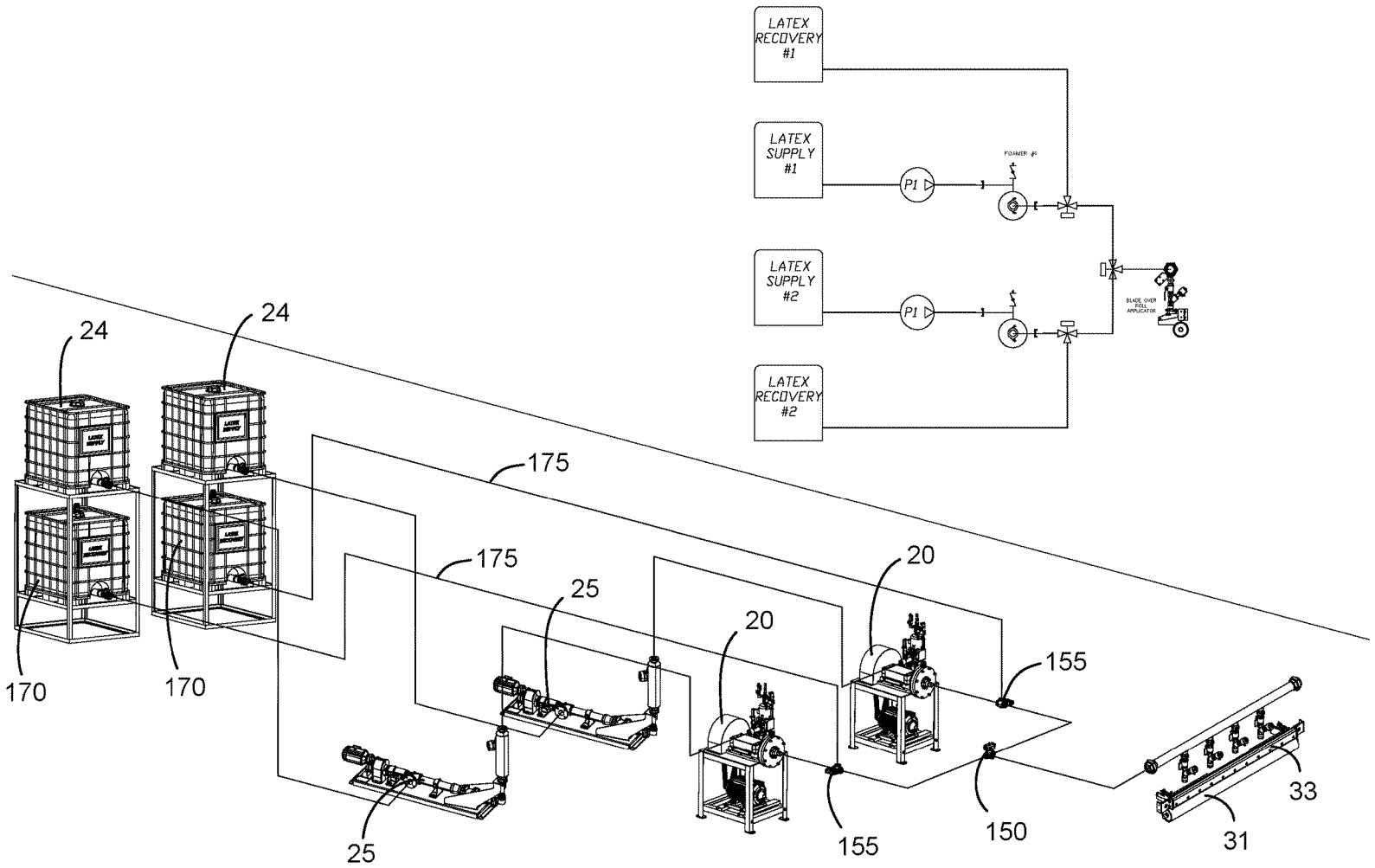
FIG. 4 is a diagram of another alternate embodiment of the invention.

FIGS. 1 and 2 illustrate an apparatus 10 for coating a first carpet web 15 fixed at a carpet seam 17 with a second carpet web 16, with two or more adhesives 25. The adhesives 25 are generated by two or more adhesive mixers 20 and conveyed to a coating apparatus 30 of the type having at least a support bed 35 and either a motorized applicator roller 32 (FIGS. 1 and 2) or a blade-type gate 33 (FIGS. 3 and 4). The coating apparatus 30 may also have a driving roller 31 to move the carpet web 15 through the coating apparatus 30.

A controller 40 of the apparatus 10 has at least a processor 50, a non-volatile memory 60 that is adapted to store at least a carpet web speed VEL and a carpet web distance-to-seam parameter $RL_2$. The controller 40 further includes a power source 90 adapted to power the apparatus 10 and, in some embodiments, the mixers 25 and the coating apparatus 30. The controller 40 further includes a sensor interface 100 and a control interface 110.

The apparatus 10 includes one or more sensors 120 for detecting a height H and a length L of a puddle 130 of one of the adhesives 25 that pools in front of the application roller 32 (FIG. 2) or the blade-type gate 33. The sensors 120 are connected with the sensor interface 100 of the controller 40 through a first sensor line 140. Such a sensor 120 may be a camera, laser edge sensor, or the like as is known in the art.

An electronic valve 150 is in fluid communication with each of the mixers 20 and with the coating apparatus 30. The electronic valve 150 is adapted to direct flow of the adhesive 25 from any of the mixers 20 to the coating apparatus 30. Typically the electronic valve 150 is a 3-way that connects one of two mixers 20 to the coating apparatus 30 (FIG. 4).

A plurality of control lines 160 each electrically connect the control interface 110 of the controller 40 to each of the adhesive mixers 20 and the electronic valve 150 (FIG. 1). The controller 40 is adapted to regulate the speed of delivery of the adhesive 25 from each of the mixers 20 and to direct the flow of the adhesive 25 from any of the mixers 20 to the coating apparatus 30 through actuation of the electronic valve 150.

Preferably the apparatus 10 further includes a seam detection sensor 180, such as an electric eye or camera arrangement as is known in the art, fixed above the carpet webs 15,16 and adapted for detecting the carpet seam 17 to alert the controller 40 of the seam 17 approaching the coating apparatus 30 via a second sensor line 185 that is electronically fixed between the seam detection sensor 180 and the controller 40.

As such, when switching from one of the adhesives 25 to another of the adhesives 25 as the carpet seam 17 of the carpet webs 15,16 pass through the coating apparatus 30, the controller 40 calculates a volume V of the puddle 130 of adhesive 25 being applied to the carpet web 15 and a remaining length $RL_1$ of the carpet web 15 that can be coated with the adhesive 25 in the puddle 130 of adhesive 25, based on a height H, length L, and either the speed VEL of the carpet web 15 passing through the coating apparatus 30 if the coating apparatus 30 applies a known rate of the adhesive 25, or the change in the volume V over time when the puddle 130 is not being replenished with adhesive 25 from the mixer 20.

When the remaining length $RL_2$ corresponds with a remaining length $RL_2$ of the carpet web 15 to the carpet seam 17, the controller 40 actuates the electronic valve 150 to switch to another of the adhesives 25, so that the puddle 130 of the adhesive 25 coats the carpet web 15, and then proximate the seam 17, the new adhesive 25 begins to coat the second carpet web 16. This assumes a constant velocity VEL of the carpet web 15 through the coating apparatus 30, which should result in a constant depletion rate of the volume V of the adhesive 25 as the carpet web 15 traverses the coating apparatus 30. Over time, or through a calibration process, discussed below, the controller 40 can learn how the depletion rate of the volume V of the adhesive 25 is affected by varying speeds of the carpet web 15 traversing the coating apparatus 30, the different types of carpet webs 15 coated by the coating apparatus 30, and the different types of adhesive 25, all being parameters stored in the non-volatile memory 60. Other environmental factors might also change these parameters, such as humidity, ambient temperature, and the like.

The controller 40 calculates the volume V of the puddle 130 by multiplying the width W (FIG. 2) of the carpet webs 15,16 by an estimate of the cross-sectional area of the puddle 130, which is an area of a triangle $A_1$ less an area $A_4$ of the triangle $A_1$ that is occupied by the applicator roller 32, plus the area of the triangle $A_2$ plus an area $A_3$ of the adhesive 25 that bulges outward when the carpet webs 15,16 are moving forward through the coating apparatus 30. The area $A_3$ of the adhesive 25 is dependent upon the viscosity of the adhesive 25 and the velocity VEL of the carpet web 15 through the coating apparatus 30, and can be measured in a calibration step (not shown). Preferably the volume V of the puddle 130 includes a volume within a delivery pipe 158 between the electronic valve 150 and the coating apparatus 30 (FIG. 1), which is simple to calculate and is based on a radius and length of the delivery pipe 158. A similar and simpler calculation can be made for coating apparatuses 30 of the type having the blade-type gate 33, wherein the estimation is taken as the area $A_2$ plus the area $A_3$, the blade-type gate 33 effectively acting as a vertical barrier on the trailing edge puddle 130.

In the calibration process, the controller 40 can shut-off the mixer 20 that is supplying the adhesive 25 to the coating apparatus 30 and then detecting how quickly the volume V drops as the adhesive 25 is applied to the carpet web 15. The remaining length $RL_1$ of the carpet web 15 that can be coated with the adhesive 25 in the puddle 130 can thereby be calculated. The radius $R_1$ of the applicator roller 32 is a parameter that is stored in the non-volatile memory 60 of the controller 40, as is the width W of the carpet web 15. As such, the one or more sensors 120 simply have to determine the height H and the length L of the puddle 130 to allow the controller to calculate the remaining length $RL_1$ of the carpet web 15 that can be coated with the adhesive 25 in the puddle 130 of adhesive 25.

In some embodiments the apparatus 10 further includes one or two recovery containers 170 (FIGS. 1, 3 and 4) fed by a recovery line 175 that is fluidly connected to the electronic valve 150, such that adhesive 25 that is not being delivered to the coating apparatus 30 through the electronic valve 150 is recovered through the recovery line 175 and saved within the recovery container 170. In some embodiments additional valves 155 (FIGS. 1 and 4) return adhesive 25 being mixed by one of the mixers 20 to the recovery container 170, or a latex or other adhesive source container 24. Additional valves 155 are connected with the controller 40 such that adhesive 25 being mixed by a mixer 20 that is not being used is returned to either the recovery container 170 or the adhesive source container 24, as appropriate for recovery or reuse.

Preferably the controller 40 controls the amount of adhesive 25 introduced to the coating apparatus 20 by varying the speed of the mixers 20 and mixing pumps 24 (FIGS. 1, 3 and 4), based on the size of the puddle 130 of the adhesive 25 in front of the applicator roller 32 or the blade-type gate 33. As such, a sufficiently-sized puddle 130 of the adhesive 25 can be constantly maintained to promote uniform coating of the adhesive 25 on the carpet webs 15,16. Also, preferably the remaining length $RL_1$ of the carpet web 15 that can be coated with the adhesive 25 in the puddle 130 never exceeds the distance between the applicator roller 32 and the seam detection sensor 180, as detection of the seam 17 would then occur too late to fully deplete the puddle 130 of adhesive 25.

In some embodiments, the apparatus 10 further includes a coating apparatus control line 200 (FIG. 1) that is electrically connected between the coating apparatus 30 and the controller 40. The controller 40 in such an embodiment is adapted to switch on or off the coating apparatus 30, and to adjust the speed VEL of the carpet webs 15,16 traveling through the coating apparatus 30, such that if the puddle 130 of adhesive 25 drops below a predetermined volume V, the coating apparatus 30 may be lowed or shut down by the controller 40. This is done for efficiency so that operators may correct any adhesive supply issues, and also for safety.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An apparatus for coating two carpet webs, fixed together at a carpet seam, with two or more adhesives from two or more adhesive mixers utilizing a coating apparatus having at least an applicator roller and a support bed, comprising:

a controller having at least a processor, a non-volatile memory adapted to store a carpet web speed and a carpet web distance-to-seam parameter, a power source adapted to power the apparatus, a sensor interface, and a control interface;

one or more sensors for detecting a height and a length of a puddle of one of the adhesives in front of the application roller, the one or more sensors connected with the sensor interface of the controller through a first sensor line;

an electronic valve in fluid communication with each of the adhesive mixers and with the coating apparatus, the electronic valve adapted to direct flow of the adhesive from any of the adhesive mixers to the coating apparatus;

a plurality of control lines each connecting the control interface of the controller to each of the adhesive mixers and the electronic valve, the controller adapted to regulate a speed of delivery of the adhesive from each of the adhesive mixers and to direct the flow of adhesive from any of the adhesive mixers to the coating apparatus through the electronic valve;

whereby when switching from one of the adhesives to another of the adhesives as the carpet seam of the carpet webs pass through the coating apparatus, the controller calculates a volume of the puddle of one of the adhesives being applied to the carpet web and a remaining length of the carpet web that can be coated with the adhesive in the puddle of one of the adhesives, based on the height of the puddle of one of the adhesives and the carpet web speed of the carpet web passing through the coating apparatus, until the remaining length of the carpet web that can be coated corresponds with a remaining length of the carpet web to the carpet seam, at which time the controller actuates the electronic valve to switch to another of the adhesives, whereby the adhesive applied to the carpet webs changes proximate the carpet seam.

2. The apparatus of claim 1 further including a recovery container and a recovery line fluidly connecting the recovery container to the electronic valve, whereby adhesive from the adhesive mixers that is not being delivered to the coating apparatus through the electronic valve is recovered through the recovery line and saved within the recovery container.

3. The apparatus of claim 1 further including a seam detection sensor fixed above the carpet webs and adapted for detecting the carpet seam thereunder and alerting the controller to such through a second sensor line electronically fixed between the seam detection sensor and the second sensor line.

4. The apparatus of claim 1 wherein the controller controls the amount of adhesive introduced to the coating apparatus based on the size of the puddle of one of the adhesives in front of the application roller, whereby a sufficiently-sized puddle of the adhesive can be constantly maintained to promote uniform coating of the adhesive on the carpet web.

5. The apparatus of claim 1 further including a coating apparatus control line electrically connecting the coating apparatus with the controller, the controller adapted to switch on or off the coating apparatus, and to adjust the carpet web speed of the carpet webs traveling through the coating apparatus, whereby if the puddle of one of the adhesives drops below a predetermined valve the coating apparatus may be slowed or stopped by the controller.

* * * * *